US008479548B2

(12) United States Patent
Ishibashi et al.

(10) Patent No.: US 8,479,548 B2
(45) Date of Patent: Jul. 9, 2013

(54) ELECTRIC WIRE DELIVERY APPARATUS AND ELECTRIC WIRE SIZING-CUTTING APPARATUS INCLUDING THE SAME

(75) Inventors: Teruyuki Ishibashi, Shizuoka (JP); Koji Higuchi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 918 days.

(21) Appl. No.: 12/213,023

(22) Filed: Jun. 13, 2008

(65) Prior Publication Data

US 2008/0314473 A1 Dec. 25, 2008

(30) Foreign Application Priority Data

Jun. 25, 2007 (JP) ..... 2007-166580

(51) Int. Cl.
*B21D 3/02* (2006.01)

(52) U.S. Cl.
USPC ..... 72/79; 72/428; 72/251; 140/149

(58) Field of Classification Search
USPC ..... 72/79, 10.1, 250, 251, 10.3, 8.8, 72/11.5, 132, 428, 203; 140/149; 226/45; 242/431
See application file for complete search history.

(56) References Cited

U.S. PATENT DOCUMENTS

| | | | | |
|---|---|---|---|---|
| 3,707,085 | A * | 12/1972 | Copenhaver | 72/428 |
| 4,639,152 | A * | 1/1987 | Yamamoto et al. | 226/45 |
| 5,348,208 | A * | 9/1994 | Tamura | 226/45 |
| 5,477,718 | A * | 12/1995 | Sakamoto et al. | 72/79 |

FOREIGN PATENT DOCUMENTS

| | | | |
|---|---|---|---|
| CN | 1826666 | A | 8/2006 |
| EP | 1034861 | A2 | 9/2000 |
| JP | 07-014444 | A | 1/1995 |
| JP | 2005-011706 | | 1/2005 |

OTHER PUBLICATIONS

Notification of the First Office Action for Chinese Patent Application No. 200810124896.9 issued Dec. 3, 2010.

* cited by examiner

*Primary Examiner* — Dana Ross
*Assistant Examiner* — Pradeep C Battula
(74) *Attorney, Agent, or Firm* — Edwards Wildman Palmer LLP; James E. Armstrong, IV; Stephen D. LeBarron

(57) ABSTRACT

An electric wire sizing-cutting apparatus including an electric wire delivery apparatus, which is easily handled and can smoothly supply the electric wire without generating a kink, is provided. The electric wire delivery apparatus includes: a transfer means transferring an electric wire, which is delivered from an electric wire reel, along a longitudinal direction of the electric wire; a correcting means arranged between the electric wire reel and the transfer means and correcting a bending habit of the electric wire by allowing the electric wire to pass through between a plurality of rollers arranged zigzag; and a rotation controlling means arranged on an upstream-side of the correcting means and putting the electric wire between a pair of rollers biased in a direction approaching each other.

8 Claims, 5 Drawing Sheets

ELECTRIC WIRE DELIVERY APPARATUS AND ELECTRIC WIRE SIZING-CUTTING APPARATUS INCLUDING THE SAME

BACKGROUND OF THE INVENTION (1) Field of the Invention

The present invention relates to an electric wire sizing-cutting apparatus for use in a manufacturing process of a wiring harness and specifically, to an electric wire sizing-cutting apparatus, in which an electric wire wound onto a reel is delivered by an electric wire delivery apparatus, a bending habit of the electric wire is corrected, and the electric wire is cut into a predetermined length.

(2) Description of the Related Art

A motor vehicle as a mobile unit mounts various electronic instruments. Therefore, the motor vehicle mounts a wiring harness, which transmits electric power from a power supply and control signals from a computer to the electronic instruments. The wiring harness includes a plurality of electric wires and connectors attached to ends of the electric wires.

The electric wire includes a core wire (electrical conductor) formed by twisting a plurality of element wires made of metal together and a coating made of electrically insulating synthetic resin, which coats the core wire. The connector includes a terminal fitting and a connector housing receiving the terminal fitting. The terminal fitting is made of conductive sheet metal and attached to an end of the electric wire so as to be electrically connected to the core wire of the electric wire. The connector housing is made of insulating synthetic resin and formed in a box-shape.

In the wiring harness, when the connector housing is connected to the electronic instrument, each electric wire is electrically connected to the electronic instrument through the terminal fitting so as to transmit electric power and signals to the electronic instrument.

When the wiring harness is being assembled, first, a long electric wire wound onto a reel is sized up and cut into a predetermined length and thereafter, the coating of an end part of the electric wire is removed and a terminal fitting is attached thereto. Thereafter, the terminal fitting is inserted into the connector housing. Thus, the wiring harness is assembled.

FIG. 5 shows an electric wire sizing-cutting apparatus (for example, see Japanese Patent Application Laid-Open No. 2005-011706) having a conventional electric wire delivery apparatus, by which a long electric wire wound onto a reel is sized up and cut into a predetermined length, in a process for manufacturing the wiring harness.

The electric wire sizing-cutting apparatus 100 shown in FIG. 5 includes: an electric wire reel 102 winding a long electric wire 112 thereonto; a transfer device 105 transferring the electric wire 112 wound onto the reel 102 in the longitudinal direction of the electric wire 112; a correcting device 104 correcting a bending habit of the electric wire 112 by passing the electric wire 112 into between the rollers 143, 144 each arranged zigzag; a hook 103 holding the electric wire 112 movable and arranged between the correcting device 104 and the reel 102; a joint detecting part 106 detecting a joint portion of the electric wire 112 wound onto the reel 102; an encoder 107 measuring a transfer amount of the electric wire 112; a cutting device 108 cutting the electric wire 112 into a predetermined length on the basis of the transfer amount of the electric wire 112 detected by the encoder 107; a control device 109 controlling the driving of the transfer device 105, joint detecting part 106 and encoder 107; and a frame 110 fixing the hook 103, correcting device 104, transfer device 105, detecting part 106 and encoder 107 and placed on a floor in a plant. The electric wire reel 102, hook 103, correcting device 104 and transfer device 105 constitute a electric wire delivery apparatus 114.

The electric wire reel 102 includes: a body part 123 formed in a column-shape and winding the electric wire 112 onto an outer peripheral surface thereof; a round cover part 122 attached on an upper surface of the body part 123; and a plurality of bearded needles 124 arranged radially from an outer edge of the cover part 122. The bearded needle 124 prevents the electric wire 112 from being delivered from the reel 102 by inertia when the movement of the electric wire 112 is stopped. That is, the bearded needle 124 functions as a back tension upon delivering of the electric wire 112. The bearded needle 124 prevents the electric wire 112 from excessively being delivered from the reel 102 so as to prevent a slack of the electric wire 112 from occurring between the reel 102 and the hook 103.

The electric wire 112 wound onto the reel 102 is a coated electric wire having an insulating coating on an outer circumference of the core wire, which is formed by winding up a plurality of element wires twisted spirally. The electric wire 112 wound onto the reel 102 forms a long electric wire 112 by bonding the core wires of a plurality of the electric wires together. In this specification, a portion at which the electric wires 112 are bonded together is called a joint portion. When a slack of the electric wire 112 takes place between the reel 102 and the hook 103, the electric wire 112 does not smoothly move on the hook 103 due to a bending habit of the electric wire 112, wherein the bending habit is provided to the electric wire 112 by being wound onto the reel 102. Therefore, the bearded needles 124 are arranged radially from the outer edge of the cover part 122 so as to prevent a slack of the electric wire 112 from occurring.

The hook 103 is attached to an end of the frame 110 near the reel 102, the height of the end being about the same as that of the correcting device 104. The hook 103 serves to supply the electric wire 112 delivered from the reel 102 to the correcting device 104 positioned at the downstream side, in a straight manner without being entangled.

The correcting device 104 includes a first correcting device 141 and a second correcting device 142 lined up along a transfer direction K of the electric wire 112. The first correcting device 141 has a plurality of rollers 143 lined up zigzag and arranged in a direction in which an axial direction of each roller 143 is parallel to a horizontal direction. The second correcting device 142 has a plurality of rollers 144 lined up zigzag and arranged in a direction in which an axial direction of each roller 144 is parallel to a vertical direction. When the electric wire 112 passes through the first and second correcting devices constructed as described above, a bending habit of the electric wire 112 is corrected and the electric wire 112 is extended straight.

The joint detecting part 106 includes a pair of rollers and a power supply (not shown in the figure) for applying a voltage to the rollers. When the core wire of the electric wire 112 passes through between the pair of the rollers with contacting the rollers, a current flows between the pair of the rollers, so that a joint portion of the electric wire 112 is detected.

Recently, the electric wire 112 for use in a wiring harness tends to be thin. When a thin electric wire 112 including a core wire having a cross sectional area of 0.13 $mm^2$ is used for the electric wire sizing-cutting apparatus 100 shown in FIG. 5, there is a problem that a kink takes place at a portion located between the electric wire reel 102 and the hook 103. Here, the kink means that a twisted electric wire 112 is deformed in a C-shape by being excessively pulled. When the kink takes place, a coating of a portion deformed in a C-shape becomes white, causing deterioration in mechanical strength of the coating.

A cause of the kink formation is that the electric wire 112 is rotated along an axial direction thereof when the electric wire 112 passes through between the rollers 143 and between the rollers 144 of the correcting device 104. In detail, since the core wire of the electric wire 112 is formed by being twisted spirally, the rollers 143 and the rollers 144 come in contact with the electric wire 112 in such a manner that the rollers 143 and the rollers 144 move along spiral grooves of the core wire through the coating, and the electric wire 112 is rotated because the electric wire 112 is successively conveyed. Then, the twist occurred due to the rotation of the electric wire 112 is stored at a portion located between the electric wire reel 102 and the hook 103. Although the electric wire 112 is prevented to some extent from slackening by the bearded needles 124, when an amount of the twist increases, the bearded needles 124 cannot control the twist any more, causing that a kink takes place at the portion described above when the electric wire 112 is delivered from the reel 102.

When the kink described above takes place at an intermediate portion of the long electric wire 112, the driving of the electric wire sizing-cutting apparatus 100 must be halted for a while so as to cut the electric wire 112 to remove the pertinent portion of the electric wire 112 before the driving is restarted, causing deterioration in productivity.

As for a conventional electric wire 112, a twist takes place when the electric wire 112 wound onto the reel 102 is pulled in an axial direction thereof by the rollers 143 and 144 of the correcting device 104. However, the electric wire 112 is rotated in a direction reverse to the twist upon passing through between the rollers 143 and 144, so that the twist is absorbed and thereby preventing a kink from occurring at a portion where the twist takes place by being pulled by the correcting device 104 on a condition that the twist takes place. When the electric wire 112 is thick, such a kink tends to hardly take place.

A method of preventing the kink from occurring, in which the rollers 143 and 144 are suitably replaced according to a pitch of twisting of the core wire of the electric wire 112, has been proposed. In this case, it is necessary to frequently replace the rollers 143 and 144, causing deterioration in productivity or a problem that the driving of the electric wire sizing-cutting apparatus 100 is performed without replacing the rollers 143 and 144.

SUMMARY OF THE INVENTION

It is therefore an objective of the present invention to solve the above problem and to provide an electric wire delivery apparatus, which can be easily used and by which an electric wire can be smoothly supplied without occurring of a kink, and an electric wire sizing-cutting apparatus including such an electric wire delivery apparatus.

In order to attain the above objective, the present invention is to provide an electric wire delivery apparatus including:

a transfer means transferring an electric wire, which is delivered from an electric wire reel, along a longitudinal direction of the electric wire;

a correcting means arranged between the electric wire reel and the transfer means and correcting a bending habit of the electric wire by allowing the electric wire to pass through between a plurality of rollers arranged zigzag; and a rotation controlling means arranged on an upstream-side of the correcting means and putting the electric wire between a pair of rollers biased in a direction approaching each other.

With the construction described above, even when the electric wire is rotated by the correcting means, the rotation controlling means prevents the twist from being transmitted to the electric wire positioned on an upstream-side of the rotation controlling means, therefore an electric wire delivery apparatus, which is easily handled and can smoothly supply the electric wire without generating a kink, can be provided.

The electric wire delivery apparatus described above further includes:

a power supply applying a voltage between the pair of the rollers of the rotation controlling means; and a detecting means detecting that the voltage is applied between the pair of the rollers from the power supply when an electrical conductor part of the electric wire comes in contact with both of the pair of the rollers, wherein the pair of the rollers of the rotation controlling means is made of electrically conductive material (i.e. electrically conductive member).

With the construction described above, the rotation controlling means can be provided with a function of detecting a joint portion of the electric wire.

In order to attain the above objective, the present invention is also to provide an electric wire sizing-cutting apparatus including:

the electric wire delivery apparatus described above;

a measuring means measuring a transfer amount of the electric wire; and a cutting means arranged on a downstream-side of the measuring means and cutting the electric wire into a predetermined length on the basis of the transfer amount of the electric wire measured by the measuring means.

With the construction described above, an electric wire sizing-cutting apparatus having high productivity and free from kink generation can be provided.

DESCRIPTION OF THE PREFERRED EMBODIMENTS

In the following, an electric wire delivery apparatus 14 according to the first preferred embodiment of the present invention and an electric wire sizing-cutting apparatus 1A including the electric wire delivery apparatus 14 will be explained with reference to FIGS. 1 and 2.

Figure 1:
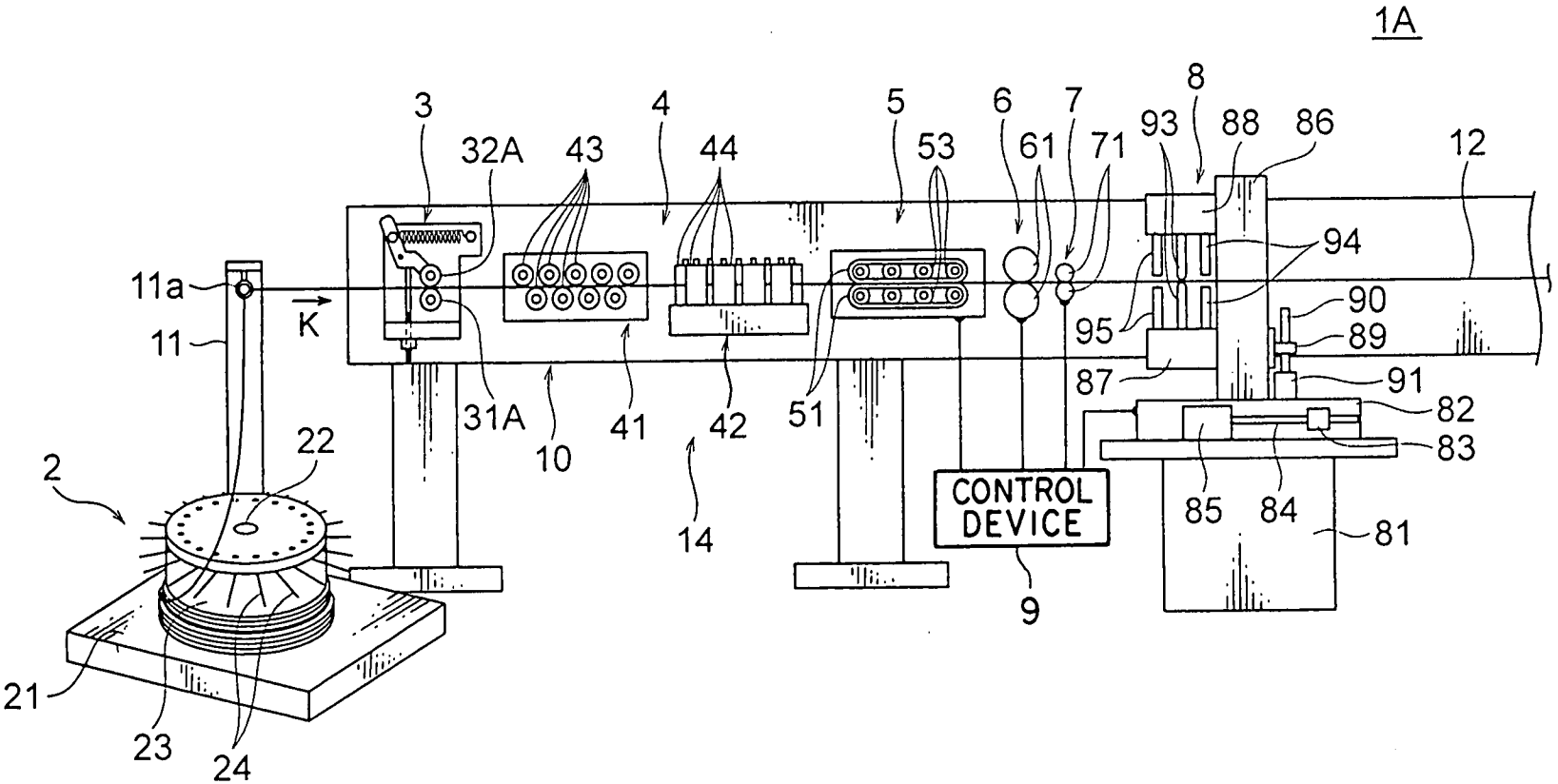
FIG. 1 illustrates an electric wire sizing-cutting apparatus including an electric wire delivery apparatus according to the first preferred embodiment of the present invention.

As shown in FIG. 1, the electric wire sizing-cutting apparatus 1A according to the first preferred embodiment delivers an electric wire 12 wound onto an electric wire reel 2, corrects a bending habit of the electric wire, and cuts the electric wire into a predetermined length.

The electric wire 12 constitutes a wiring harness to be mounted on a motor vehicle as a mobile unit. The electric wire 12 includes an electrically conductive core wire 12*b* (see FIG. 4) as the electrical conductor part and an electrically insulating coating 12*a* (see FIG. 4) which coats the core wire 12*b*. The core wire 12*b* is constructed by spirally twisting a plurality of element wires made of metal. A cross sectional area of the core wire 12*b* is 0.13 $mm^2$. The coating 12*a* is made of, for example, synthetic resin such as polyvinylchloride (PVC). An end of the electric wire 12 is attached to a connector, so that a wiring harness is constructed. The connector is connected to a mating connector of various electronic instruments in a motor vehicle, so that the wiring harness, i.e. the electric wire 12 transmits electric power and various signals to the electronic instrument.

The electric wire sizing-cutting apparatus 1A includes an electric wire delivery apparatus 14 having: the electric wire reel 2; a transfer device 5 as the transfer means transferring the electric wire 12 wound onto the reel 2 in a longitudinal direction of the electric wire 12; a correcting device 4 as the correcting means arranged between the reel 2 and the transfer device 5 and correcting a bending habit of the electric wire 12; a rotation controlling device 3 as the rotation controlling means arranged on an upstream-side of the correcting device 4; a holding part 11 arranged between the reel 2 and the rotation controlling device 3 and holding movably the electric wire 12 delivered from the reel 2; and a control device 9, a joint detecting part 6 detecting a joint portion of the electric wire 12 wound onto the reel 2, an encoder 7 as the measuring means measuring a transfer amount of the electric wire 12, a cutting device 8 as the cutting means arranged on a downstream-side of the encoder 7 and cutting the electric wire 12 into a predetermined length on the basis of the transfer amount of the electric wire 12 measured by the encoder 7, and a frame 10 fixing the rotation controlling device 3, correcting device 4, transfer device 5, joint detecting part 6 and encoder 7 and placed on a floor in a plant.

The electric wire reel 2 includes: a body part 23 formed in a column-shape and winding the electric wire 12 onto an outer peripheral surface thereof; a plate-shaped base 21 attaching rotatably the body part 23; and a round cover part 22 attached on an upper surface of the body part 23; and a plurality of bearded needles 24 arranged radially from an outer edge of the cover part 22. The bearded needle 24 is formed by a resilient linear matter and comes in contact with the electric wire 12 delivered. That is, the bearded needle 24 prevents the electric wire 12 from being delivered from the reel 2 by inertia when the movement of the electric wire 12 is stopped. That is, the bearded needle 24 functions as a back tension upon delivering of the electric wire 12. The bearded needle 24 prevents the electric wire 12 from excessively being delivered from the reel 2 so as to prevent a slack of the electric wire 12 from occurring between the reel 2 and the rotation controlling device 3.

The electric wire 12 wound onto the reel 2 is constructed as a long electric wire 12 with the core wires 12*b* of a plurality of the electric wires 12 being bonded together at respective end parts of the core wire 12*b*. In this specification, a portion at which the electric wires 12 are joined together is called a joint portion of the electric wire 12.

The transfer device 5 includes a pair of rotary belts 51 which is rotated by a plurality of rotary belts 53 lined up in the transfer direction of the electric wire 12. The pair of the rotary belts 51 puts the electric wire 12 therebetween and rotates in respective directions reverse to each other so as to transfer the electric wire 12 along a direction indicated by an arrow K (hereinafter, transfer direction K) in FIG. 1. The electric wire 12 is pulled by the transfer device 5, so that the electric wire 12 is delivered from the electric wire reel 2. The control device 9 controls the driving of the transfer device 5.

The correcting device 4 includes a first correcting device 41 and second correcting device 42 lined up along the transfer direction K of the electric wire 12. The first correcting device 41 includes a plurality of rollers 43, which are lined up zigzag along the transfer direction K and allows the electric wire 12 to pass through therebetween so as to correct a bending habit of the electric wire 12. An axial direction of the roller 43 is parallel to the horizontal direction. The second correcting device 42 includes a plurality of rollers 44, which are lined up zigzag along the transfer direction K and allows the electric wire 12 to pass through therebetween so as to correct a bending habit of the electric wire 12. An axial direction of the roller 44 is parallel to the vertical direction. When the electric wire 12 passes through the first correcting device 41 and the second correcting device 42 constructed as described above, a bending habit of the electric wire 12 is corrected and the electric wire 112 is extended straight.

Figure 2:
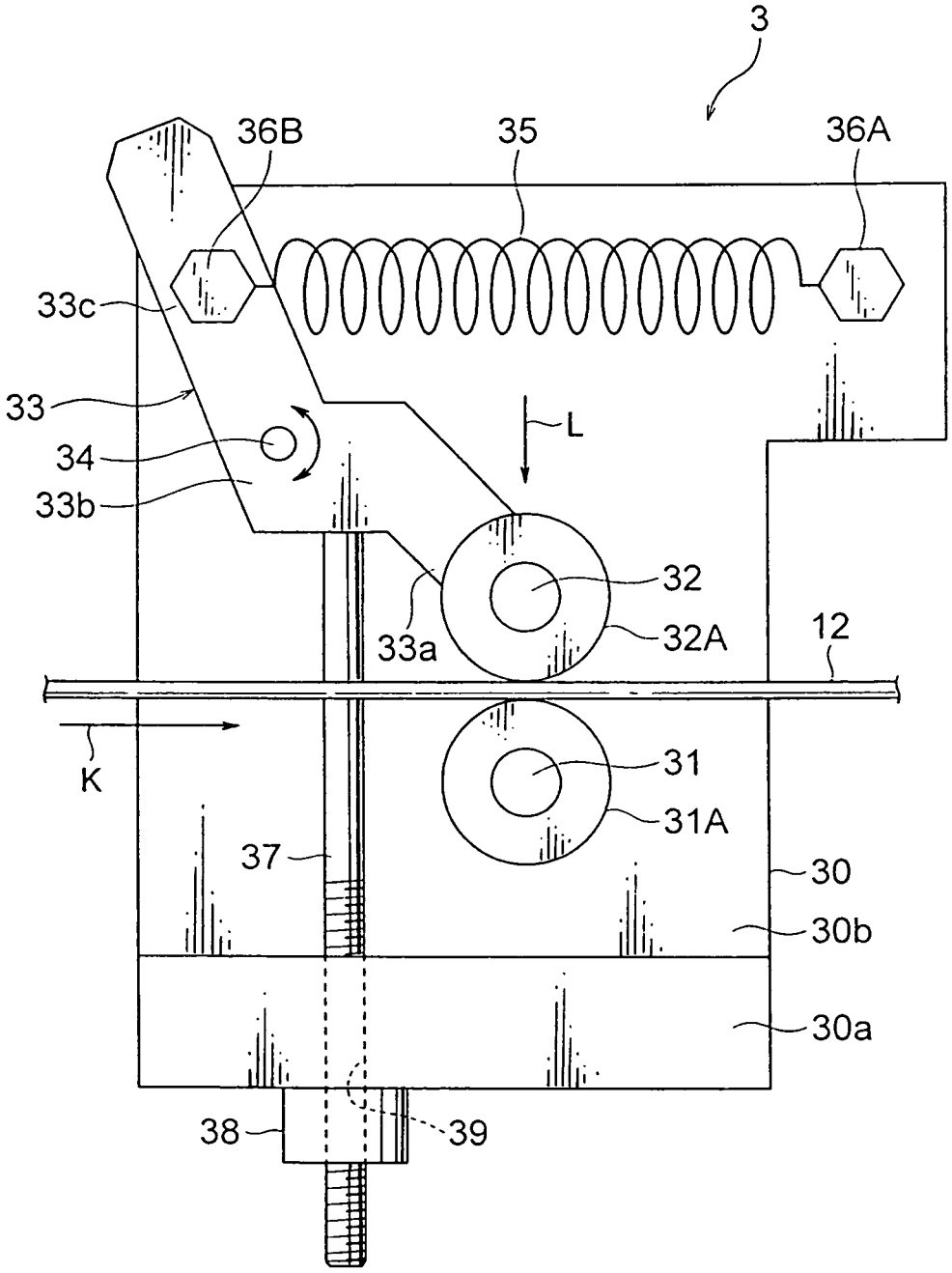
FIG. 2 is an enlarged view of a rotation controlling device constituting the electric wire delivery apparatus shown in FIG. 1.

As shown in FIG. 2, the rotation controlling device 3 includes a plate 30 fixed to the frame 10, a pair of rollers 31A, 32A arranged spaced from each other along a direction crossing the transfer direction K at right angles, a support member 33 attached to the roller 32A, a coil spring 35, and a guide bar 37.

The plate 30 includes: a first surface 30*b*, which is formed in a plate-shape and arranged in parallel to a plane direction of an attaching part of the frame 10; and a second surface 30*a*, which is formed in a plate-shape and rises up from a lower end of the first surface 30*b* in a direction crossing the first surface 30*b* at right angles.

The roller 31A is rotatably attached to the first surface 30*b* through an attaching shaft 31. The roller 32A is rotatably attached to an end part 33*a* of the support member 33 through an attaching shaft 32. The roller 32A is arranged above the roller 31A in the vertical direction.

The support member 33 is formed approximately in a S-shape in plan view and is provided rotatable with respect to the first surface 30*b* by an attaching shaft 34, which connects a central part 33*b* of the support member 33 to the first surface 30*b*.

As for the coil spring 35, one end 36A thereof is fixed at a position located on the downstream-side of the attaching shaft 34 of the first surface 30*b* in the transfer direction K, while an opposite end 36B thereof is attached to a rear end part 33*c* of the support member 33 away from an end part 33*a* of the support member 33. The coil spring 35 is attached on a condition that a resilient restoring force in a direction of contraction of the coil spring 35 is generated. Thereby, the roller 32A is biased in a direction (indicated by an arrow L in FIG. 2) in which the roller 32A approaches the roller 31A.

The guide bar 37 is formed in a column-shape and rises up from the second surface 30*a*. That is, a longitudinal direction of the guide bar 37 crosses the longitudinal direction of the electric wire 12, which is allowed to pass through between the pair of the rollers 31A, 32A. The guide bar 37 is arranged on the upstream-side of the pair of the rollers 31A, 32A in the transfer direction K. The guide bar 37 abuts against an outer surface of the electric wire 12 so as to position the electric wire 12 along the horizontal direction and along a direction crossing the transfer direction K of the electric wire 12 at right angles.

The rotation controlling device 3 constructed as described above puts the electric wire 12 between the pair of the rollers 31A, 32A so as to prevent the electric wire 12 from rotating around an axis of the electric wire 12 and permits the electric wire 12 to move in the longitudinal direction thereof. A force which puts the electric wire 12 between the pair of the rollers 31A, 32A is set to be about 1 newton (N). The rotation controlling device 3 may attach the roller 31A to the attaching shaft 31 by using the attaching shaft 31, which has been provided to attach the hook 103 to the frame 110 in the conventional electric wire sizing-cutting apparatus 100.

According to the present invention, since the rotation controlling device 3 prevents the electric wire 12 from rotating around an axis thereof, therefore even if the correcting device 4 rotates the electric wire 12, the electric wire 12, which is positioned on the upstream-side of the rotation controlling device 3, that is, positioned between the electric wire reel 2 and the rotation controlling device 3, can be prevented from twisting, so that the electric wire 12 can be smoothly supplied without generation of a kink.

The holding part 11 is placed on a floor and includes a ring 11*a* which allows the electric wire 12, which is attached at a position having the same height as that of the rotation controlling device 3, to movably pass therethrough. The ring 11*a* supplies the electric wire 12 delivered from the reel 2 straight to the rotation controlling device 3, which is positioned downstream, without entanglement of the electric wire 12.

The control device 9 is a computer including a RAM, ROM and CPU. The control device 9 is connected to the rotary rollers 53 of the transfer device 5, joint detecting part 6, encoder 7 and cutting device 8 so as to control the whole electric wire sizing-cutting apparatus 1A. The control device 9 stores a length of the electric wire 12 to be cut and drives the rollers 53 of the transfer device 5 and cutting device 8 on the basis of data of the transfer amount of the electric wire 12 transmitted from the encoder 7.

The joint detecting part 6 includes a pair of rollers 61 permitting the electric wire 12 to pass through therebetween and an electric source (not shown in the figure) applying a voltage onto the rollers 61. When the core wire 12*b* of the electric wire 12 passes through the pair of rollers 61 and comes in contact with pair of rollers 61, a current flows between the pair of the rollers 61, so that the joint detecting part 6 detects a joint portion of the electric wire 12. The joint detecting part 6 is connected to the control device 9. When the joint detecting part 6 detects the joint portion of the electric wire 12, the joint detecting part 6 transmits a signal to the control device 9. The joint portion of the electric wire 12 is cut by the cutting device 8 and is not used for a product.

The encoder 7 includes a pair of rotators 71. Each rotator 71 rotates around an axis thereof. An outer circumferential surface of the rotator 71 comes in contact with an outer surface of the electric wire 12 being transferred along the transfer direction K. The rotators 71 rotate when the electric wire 12 is transferred along the transfer direction K. That is, the rotators 71 rotate around the axis thereof when the electric wire 12 is transferred along the transfer direction K. Of course, a transfer distance of the electric wire 12 along the transfer direction K is in proportion to the revolving number of the rotator 71. The encoder 7 is connected to the control device 9. When the rotator 71 rotates a predetermined angle, the encoder 7 transmits a pulse signal to the control device 9. That is, the encoder 7 transmits a pulse signal corresponding to a transfer amount of the electric wire 12 along the transfer direction K to the control device 9.

The cutting device 8 includes: a pair of cutting blades 93; two pairs of peeling blades 94, 95; bases 87, 88 attaching these blades; a support part 86 supporting the bases 87, 88 so as to allow the bases 87 and 88 to approach or leave each other; a motor 91 allowing the bases 87 and 88 to approach or leave each other; a screw shaft 90 connected to an axis of the motor 91; a slider 89 attached to the base 87 and moving on the screw shaft 90; a base 82 attaching the support part 86 and the motor 91; a motor 85 transferring reciprocatingly the base 82 along the transfer direction K; a screw shaft 84 connected to a shaft of the motor 85; a slider 83 attached to the base 82 and moving on the screw shaft 84; and a pedestal 81 placed on a floor and attaching the base 82 and the motor 85.

The cutting device 8 cuts the electric wire 12 when the pair of the cutting blades 93 approaches each other. The two pairs of peeling blades 94, 95 cut deep into the respective coatings 12*a* located at one end and an opposite end of the electric wire 12. When the two pairs of peeling blades 94, 95 move along the transfer direction K after approaching one another, the two pairs of peeling blades 94, 95 remove the coatings 12*a* located at the one end and the opposite end of the electric wire 12.

The electric wire sizing-cutting apparatus 1A delivers the electric wire 12 wound onto the electric wire reel 2, corrects a bending habit of the electric wire 12, and cuts the electric wire 12 into a predetermined length as follows.

As a preparation step, an end of the electric wire 12 wound onto the electric wire reel 2 is allowed to pass through the ring 11*a*, between the pair of the rollers 31A and 32A, between a plurality of the rollers 43 of the first correcting device 41, between a plurality of the rollers 44 of the second correcting device 42, between the pair of the rollers 61 of the joint detecting part 6, and between the pair of the rotators 71 of the encoder 7. The pair of the cutting blades 93 of the cutting device 8 and the two pairs of peeling blades 94, 95 are positioned at respective positions spaced from one another.

An electric source of the electric wire sizing-cutting apparatus 1A is turned on so as to start driving of the rotary rollers 53 of the transfer device 5. Then, the pair of rotary belts 51, which rotates reversely to each other when the rotary rollers 53 rotate, puts the electric wire 12 therebetween and moves the electric wire 12 along the transfer direction K.

Then, the electric wire 12 delivered from the transfer device 5 is allowed to pass through between the pair of the rollers 31A and 32A so as to be supplied to the correcting device 4. At that time, the electric wire 12 positioned on an upstream-side of the pair of the rollers 31A and 32A is prevented from being twisted. A bending habit of the electric wire 12, which is allowed to pass through between a plurality of the rollers 43, 44 of the correcting device 4, is corrected, wherein the bending habit is caused by being wound onto the reel 2.

When the control device 9 judges that a leading end of the electric wire 12 in the transfer direction K passes through between the cutting blades 93, the control device 9 once halts the driving of the rotary rollers 53 and starts the driving of the cutting device 8.

The cutting device 8 cuts the electric wire 12 by allowing the pair of the cutting blades 93 to approach each other, nips an end of the electric wire 12 situated on the side connected to the reel 2 by allowing the pair of the peeling blades 95 to approach each other, and makes the pair of the peeling blades 95 move along the transfer direction K so as to remove (peel) the coating 12*a* of the end of the electric wire 12. Thereafter, the cutting device 8 positions the pair of the cutting blades 93 and the pair of the peeling blades 95 at respective original positions where they are positioned when the electric source of the electric wire sizing-cutting apparatus 1A is turned on. Then, the control device 9 starts the driving of the rotary rollers 53 again.

When the control device 9 judges that a transfer amount of the electric wire 12 transmitted from the encoder 7 reaches a predetermined length stored in advance in the control device 9, that is, that the electric wire 12 having a length for constructing a wiring harness passes through between the cutting blades 93, the control device 9 once halts the driving of the rotary rollers 53 and starts the driving of the cutting device 8.

The cutting device 8 cuts the electric wire 12 by allowing the pair of the cutting blades 93 to approach each other, nips a rear end of the electric wire 12 separated from the reel 2-side by allowing the pair of the peeling blades 94 to approach each other, and makes the pair of the peeling blades 94 move along a direction reverse to the transfer direction K so as to remove (peel) the coating 12*a* of the rear end of the electric wire 12. Further, cutting device 8 allows the pair of the peeling blades 95 to approach each other with simultaneously allowing the pair of the peeling blades 94 to approach each other, so as to nip a leading end of the electric wire 12 in the transfer direction K situated on the side connected to the reel 2. Then, after the pair of the peeling blades 94 peels off the rear end of the front-side electric wire 12, the cutting device 8 allows the pair of the peeling blades 95, which nips the end of the electric wire 12 situated on the side connected to the reel 2, to move along the transfer direction K so as to remove the coating 12*a* of the end of the electric wire 12.

When the joint portion of the electric wire 12 is positioned between the pair of the rollers 61 and a joint portion detecting signal is transmitted from the joint detecting part 6 to the control device 9, the control device 9 starts to drive the cutting device 6 so as to cut the joint portion of the electric wire 12.

By repeating these processes described above, the electric wire 12, which is cut into a predetermined length, and the coating 12*a* at both ends of which are removed, is obtained. Such an electric wire 12 processed as described above is transferred to a terminal-connecting device provided on a downstream-side of the cutting device 8. Then, a terminal is press-fit to a core wire 12*b* exposed being peeled by the terminal-connecting device. Since such an electric wire 12 processed as described above is in a condition that a bending habit thereof is corrected by the correcting device 4 and it is straightly extended, therefore the press-fitting step as described above can be performed smoothly.

According to the preferred embodiment described above, even when the electric wire 12 is rotated by the rollers 43, 44 of the correcting device 4, by nipping the electric wire 12 with the pair of the rollers 31A and 32A, the electric wire 12 positioned on an upstream-side of the rotation controlling device 3 can be prevented from being twisted, therefore the electric wire 12 can be smoothly supplied without generation of a kink.

Figure 3:
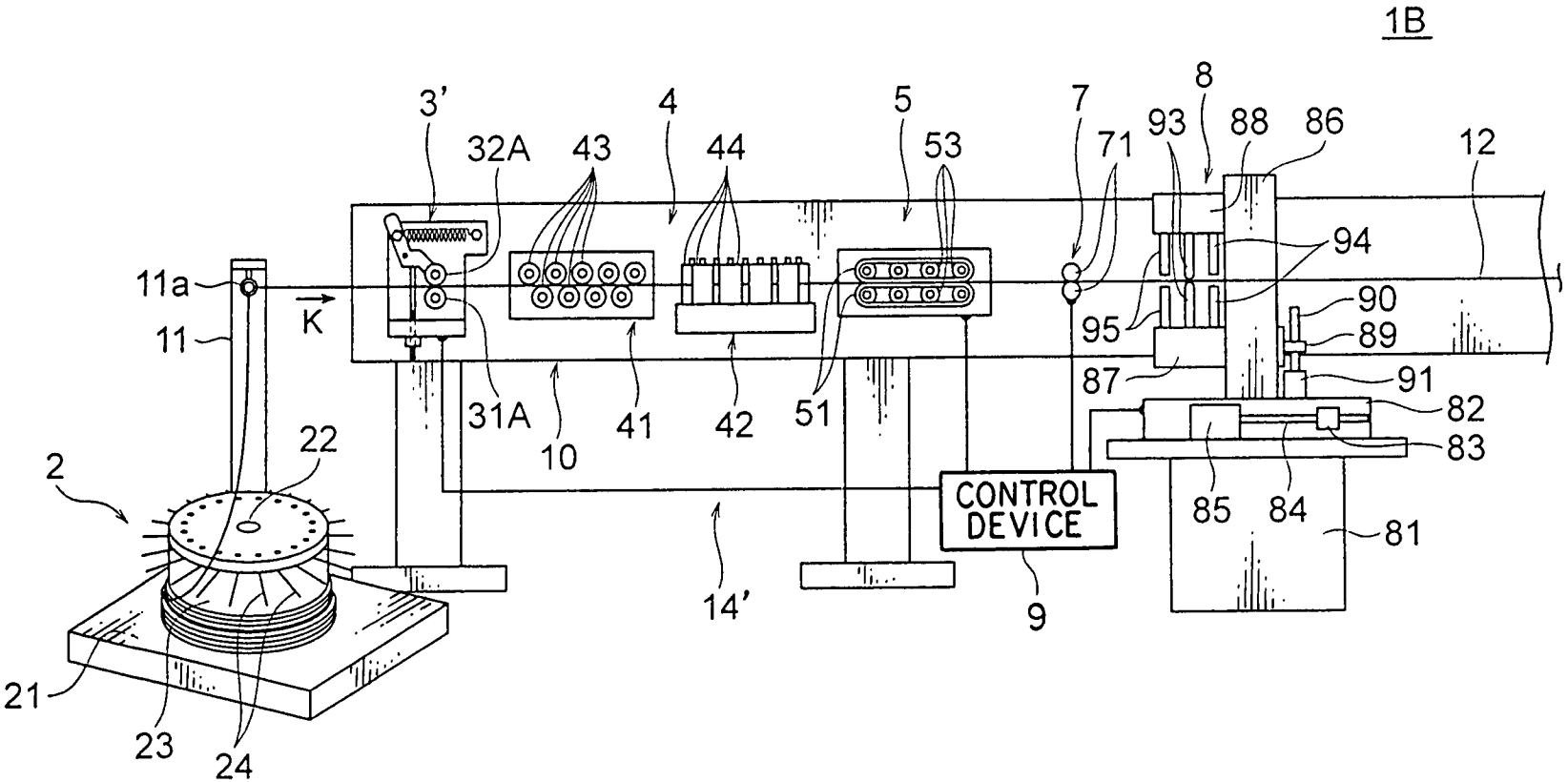
FIG. 3 illustrates an electric wire sizing-cutting apparatus including an electric wire delivery apparatus according to the second preferred embodiment of the present invention.

In the following, an electric wire delivery apparatus 14' according to the second preferred embodiment of the present invention and an electric wire sizing-cutting apparatus 1B including the electric wire delivery apparatus 14' will be explained with reference to FIGS. 2 and 3.

The electric wire sizing-cutting apparatus 1B according to the second preferred embodiment does not includes the joint detecting part 6 of the first preferred embodiment and instead, includes the electric wire delivery apparatus 14' having a rotation controlling device 3'.

Figure 4:
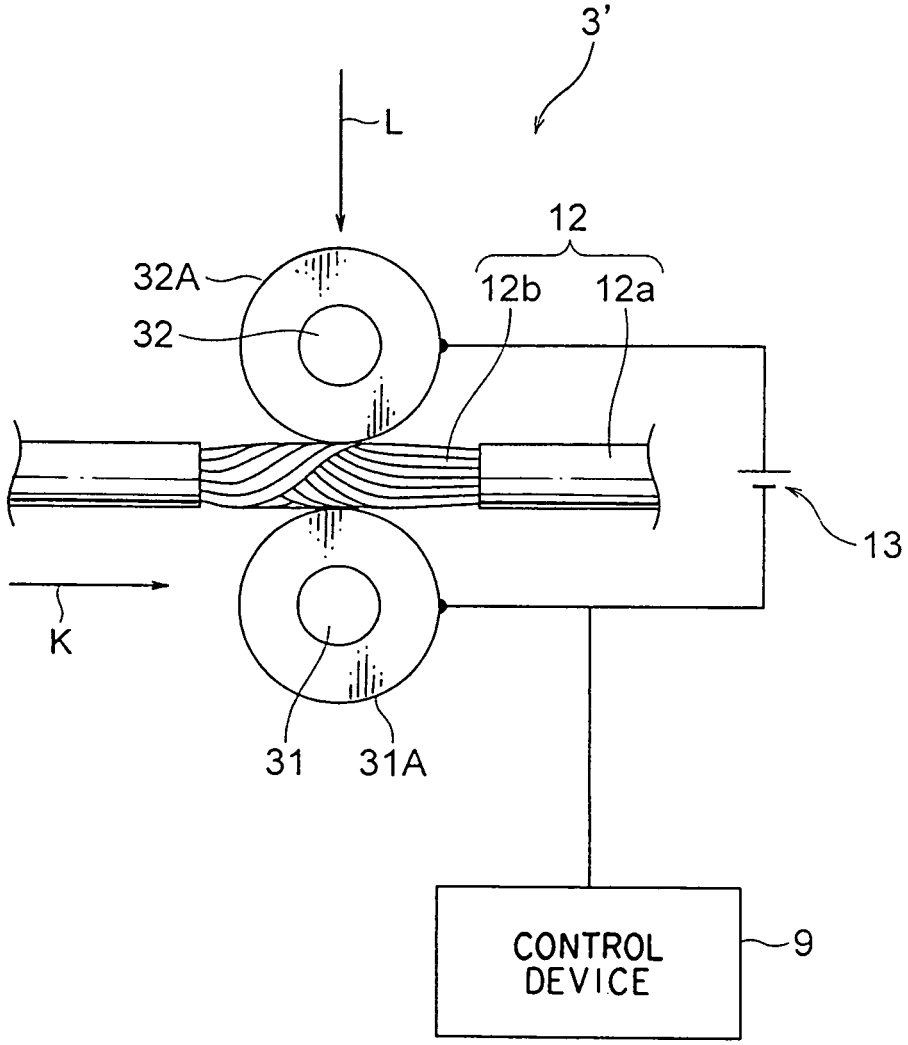
FIG. 4 is an illustration for explaining the electric wire delivery apparatus shown in FIG. 3.
Figure 5:
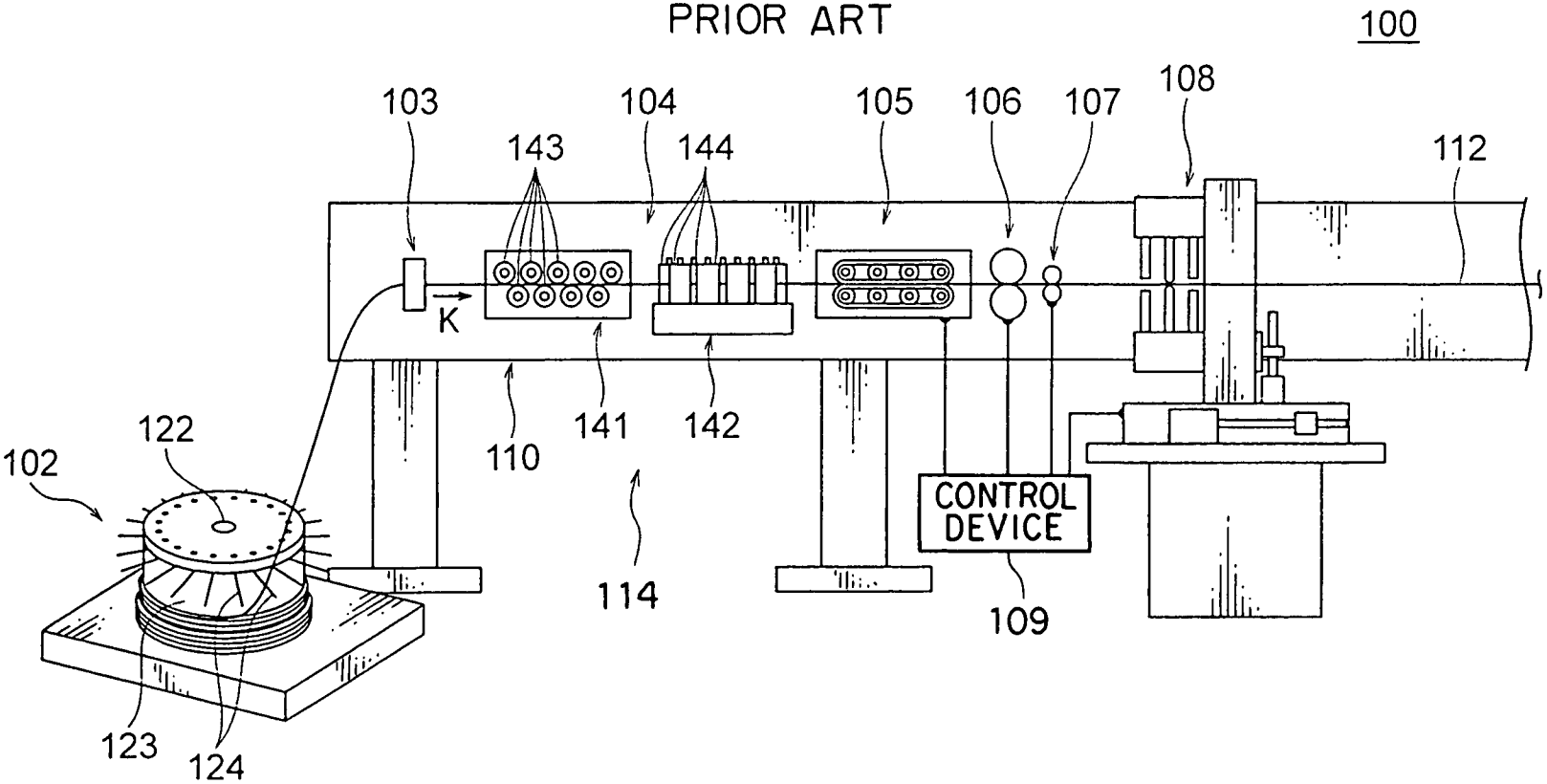
FIG. 5 PRIOR ART
FIG. 5 illustrates a conventional electric wire sizing-cutting apparatus including a conventional electric wire delivery apparatus.

As shown in FIG. 4, the rotation controlling device 3' includes an electric source 13 in addition to the rotation controlling device 3 of the first preferred embodiment and the pair of the rollers 31A, 32A is made of electrically conductive material (i.e. electrically conductive member). The electric source 13 applies a voltage between the pair of the rollers 31A, 32A. In an electrical circuit constructed by the electric source 13 and the pair of the rollers 31A, 32A, a joint portion of the electric wire 12 is positioned between the pair of the rollers 31A, 32A and the core wire 12*b* of the electric wire 12 comes in contact with both of the pair of the rollers 31A, 32A, so that a current flows between the pair of the rollers 31A, 32A. Further, the control device 9 is connected to the electrical circuit. When a current flows between the pair of the rollers 31A, 32A, that is, when a joint portion of the electric wire 12 is positioned between the pair of the rollers 31A, 32A, the control device 9 detects the situation (i.e. application of the voltage) described above. The control device 9 corresponds to the detecting means.

According to the second preferred embodiment, the rotation controlling device 3' is provided with a function of detecting a joint portion of the electric wire 12. Therefore, the joint detecting part 6 of the first preferred embodiment can be omitted, so that a size of the electric wire sizing-cutting apparatus 1B can be small.

The aforementioned preferred embodiments are described to aid in understanding the present invention and variations may be made by one skilled in the art without departing from the spirit and scope of the present invention.

What is claimed is:

1. An electric wire delivery apparatus comprising:

a transfer means transferring an electric wire, which is delivered from an electric wire reel, along a longitudinal direction of the electric wire;

a correcting means arranged between the electric wire reel and the transfer means and correcting a bending habit of the electric wire by allowing the electric wire to pass through between a plurality of rollers arranged zigzag;

a rotation controlling means arranged on an upstream-side of the correcting means and putting the electric wire between a pair of rollers biased in a direction approaching each other; and a guide bar, arranged on an upstream-side of the pair of rollers within the rotation controlling means, which abuts against an outer surface of the electric wire so as to position the electric wire along the horizontal direction and along a direction crossing a transfer direction of the electric wire at right angles, wherein the rotation controlling means includes a support member movably attached to one of the pair of rollers at an angle, the support member attached on one end to the one of a pair of rollers and an other end to a coil spring.

2. The electric wire delivery apparatus according to claim 1, further comprising:

a power supply applying a voltage between the pair of the rollers of the rotation controlling means; and a detecting means detecting that the voltage is applied between the pair of the rollers from the power supply when an electrical conductor part of the electric wire comes in contact with both of the pair of the rollers, wherein the pair of the rollers of the rotation controlling means is made of electrically conductive material.

3. An electric wire sizing-cutting apparatus comprising:

the electric wire delivery apparatus according to claim 2;

a measuring means measuring a transfer amount of the electric wire; and a cutting means arranged on a downstream-side of the measuring means and cutting the electric wire into a predetermined length on the basis of the transfer amount of the electric wire measured by the measuring means.

4. An electric wire sizing-cutting apparatus comprising:

the electric wire delivery apparatus according to claim 1;

a measuring means measuring a transfer amount of the electric wire; and a cutting means arranged on a downstream-side of the measuring means and cutting the electric wire into a predetermined length on the basis of the transfer amount of the electric wire measured by the measuring means.

5. An electric wire delivery apparatus comprising:

a transfer device transferring an electric wire delivered from an electric wire reel along a longitudinal direction of the electric wire, the transfer device including a pair of oppositely disposed rotary belts arranged in a transfer direction of the wire, the rotary belts receiving the electric wire therebetween so as to transfer the wire along the longitudinal direction thereof;

a correcting device arranged between the electric wire reel and the transfer device and correcting a bending habit of the electric wire by allowing the electric wire to pass between a plurality of rollers arranged in a zigzag configuration, the correcting device including first and second correcting devices each comprising a plurality of rollers arranged in a zigzag configuration, wherein an axis of rotation of the plurality of rollers corresponding to the first correcting device is perpendicularly disposed relative to an axis of rotation of the plurality of rollers corresponding to the second correcting device;

a rotation controlling device arranged on an upstream-side of the correcting device and including a pair of rollers receiving the electric wire therebetween, the rollers biased in a direction toward each other so as to apply a force upon the electric wire passing therebetween;

a guide bar, arranged on an upstream-side of the pair of rollers within the rotation controlling device, which abuts against an outer surface of the electric wire so as to position the electric wire along the horizontal direction and along a direction crossing a transfer direction of the electric wire at right angles, wherein the rotation controlling device includes a support member attached to one of the pair of rollers, the support member biased by a coil spring; and a holding part arranged positioned above the reel and between the reel and the rotation controlling device, the holding part including a ring member disposed at a height that is substantially the same as a height of the rotation controlling device, the ring member receiving the electric wire therein from the wire reel and directing the wire to the rotation controlling device along the transfer direction.

6. The electric wire delivery apparatus according to claim 5, further comprising:

a power supply applying a voltage between the pair of the rollers of the rotation controlling means; and a detecting means detecting that the voltage is applied between the pair of the rollers from the power supply when an electrical conductor part of the electric wire comes in contact with both of the pair of the rollers, wherein the pair of the rollers of the rotation controlling means is made of electrically conductive material.

7. An electric wire sizing-cutting apparatus comprising:

the electric wire delivery apparatus according to claim 6;

a measuring means measuring a transfer amount of the electric wire; and a cutting means arranged on a downstream-side of the measuring means and cutting the electric wire into a predetermined length on the basis of the transfer amount of the electric wire measured by the measuring means.

8. An electric wire sizing-cutting apparatus comprising:

the electric wire delivery apparatus according to claim 5;

a measuring means measuring a transfer amount of the electric wire; and a cutting means arranged on a downstream-side of the measuring means and cutting the electric wire into a predetermined length on the basis of the transfer amount of the electric wire measured by the measuring means.

* * * * *